United States Patent [19]

Logan, Jr. et al.

[11] Patent Number: 4,720,128

[45] Date of Patent: Jan. 19, 1988

[54] MAGNETIC EMERGENCY EXIT DOOR LOCK WITH TIME DELAY

[75] Inventors: Emanuel L. Logan, Jr., Columbia, Md.; Bruce G. Beigel, Seven Valleys; Michael A. Kelly, Felton, both of Pa.

[73] Assignee: Reliable Security Systems, Inc., Cockeysville, Md.

[21] Appl. No.: 924,475

[22] Filed: Oct. 29, 1986

Related U.S. Application Data

[63] Continuation of Ser. No. 700,867, Feb. 14, 1985, Pat. No. 4,652,028.

[51] Int. Cl.[4] ..... E05C 17/56

[52] U.S. Cl. ..... 292/251.5

[58] Field of Search ..... 340/545, 547, 542, 540, 340/541; 49/26, 29–31; 70/92, 93, 91, 267; 292/DIG. 19, DIG. 65, 201, 144, 92, 21; 200/61.62, 61.64, 61.81, 61.82; 361/160, 170

[56] References Cited

U.S. PATENT DOCUMENTS

| | | | |
|---|---|---|---|
| 4,123,752 | 10/1978 | Novotny | 340/545 |
| 4,284,980 | 8/1981 | Hainski | 340/545 |
| 4,609,910 | 9/1986 | Geringer et al. | 70/92 X |

*Primary Examiner*—Richard E. Moore

*Attorney, Agent, or Firm*—Millen & White

[57] ABSTRACT

A door mounted in a door frame is held closed by an electromagnet mounted on the door frame which magnet attracts an armature mounted on the door. A switch is mounted adjacent to the electromagnet and is operated by a switch operator mounted on the door. The switch provides a signal indicating that an attempt is being made to open the door, which signal may be used to sound an alarm or start a time delay release. A pair of contacts are also mounted adjacent to the electromagnet and are bridged by the armature to indicate when the armature is properly held by the electromagnet.

16 Claims, 6 Drawing Figures

MAGNETIC EMERGENCY EXIT DOOR LOCK WITH TIME DELAY

This is a continuation of application Ser. No. 700,867, filed Feb. 14, 1985, now U.S. Pat. No. 4,652,028, issued Mar. 24, 1987.

BACKGROUND OF THE INVENTION

1. Field of the Invention

The instant invention relates of emergency exit door systems. More particularly, the instant invention relates to emergency exit door security systems wherein the system includes a time delay which delays opening of an emergency exit door after an attempt has been made to open the door. Moreover the instant invention relates to structures and systems utilizing electromagnetic locks for securing emergency exit doors, or doors in general, whether or not a time delay is utilized.

2. Technical Considerations and Prior Art

The numerous patents listed above as "Related Patents" are generally directed to devices for delaying opening of emergency exit doors to prevent unauthorized exit from a building or room. Of particular interest with respect to the instant invention is U.S. Pat. No. 4,257,631, "Magnetic Emergency Exit Door Lock With Delayed Opening." As is readily apparent from the disclosure of this patent, initiation of a delayed time, opening interval is effected by pushing on the panic bar of the emergency exit door. The panic bar depresses a plunger of a switch, which switch in return is connected to a time delay circuitry. Since the time delay circuitry is not disposed on the door, the line connecting the time delay circuitry to the switch must jump the gap between the hinged edge of the door and the door frame. In order to solve this problem, an "electric hinge" is utilized, which hinge has conductors and/or connectors therein for carrying current across the gap. These hinges are very expensive and are frequently difficult to select. This is because it is preferable than an electric hinge match the hinge set which a door is designed to accept. Frequently, a matching electric hinge is not available. In order to connect the switch to the time delay circuitry a wire is usually run through the interior of the door to the electric hinge. Moreover, the wire must be run from the door jam side of the hinge through the door jam or wall to the circuitry. Running these wires is a time consuming, expensive operation.

In addition to the economic considerations, there are mechanical and safety considerations. There are numerous types of panic bars now on the market with which the switch must be mated. Accordingly, it is frequently difficult to configure the design and location of the switch so that it will operate with the particular panic hardware under consideration. Moreover, in many installations, the switch is exposed and therefore subject to damage and vandalism. Consequently, the switch may not operate properly when there is a need to open the emergency exit.

The assignee of the inventors named in the instant application has found that there is a market for magnetic locks both the time delay feature and without the time delay feature. This is because it is frequently necessary, for one reason or another, to provide an indication that someone is attempting to open an emergency exit door. This indication may be used to start a time delay count in accordance with the principles disclosed and claimed in the aforelisted "Related Patents" or may simply be used to trip an alarm. For whatever the reason that it is necessary to provide such indication, existing door security systems utilizing magnetic locks need a convenient, reliable and inexpensive way to provide such indication.

SUMMARY OF THE INVENTION

In view of the deficiencies of the prior art, it is a feature of the instant invention to provide new and improved apparatus for indicating that an attempt is being made to open a door equipped with a magnetic lock.

In order to accomplish this feature, the instant invention contemplates a door locking arrangement wherein an armature is mounted on a door and an electromagnet is mounted on a adjacent door jam. A switch is mounted on the door jam and a switch operator on the door for operating the switch in response to movement of the door. The switch is associated with a circuit which indicates the following conditions:

1. The door is closed,
2. The door is open, and
3. An attempt is being made to move the door from a closed position to an open position.

In accordance with a preferred embodiment, the switch is mounted in proximity with the electromagnet and the switch operator is proximity to the armature.

The instant invention further contemplates electrical contact sturcture, juxtaposed with the electromagnet, which contact structure is engaged by the armature upon closing the door to indicate that the armature is being formly held by the electromagnet.

In order to assure proper contact between the armature and electromagnet, the armature is mounted loosely on the door so that it will float with respect thereto. This compensates for misalignment between the armature and electromagnet due to errors either in mounting the electromagnet or in the plumb of the door.

DESCRIPTION OF THE PREFERRED EMBODIMENT

Figure 1:
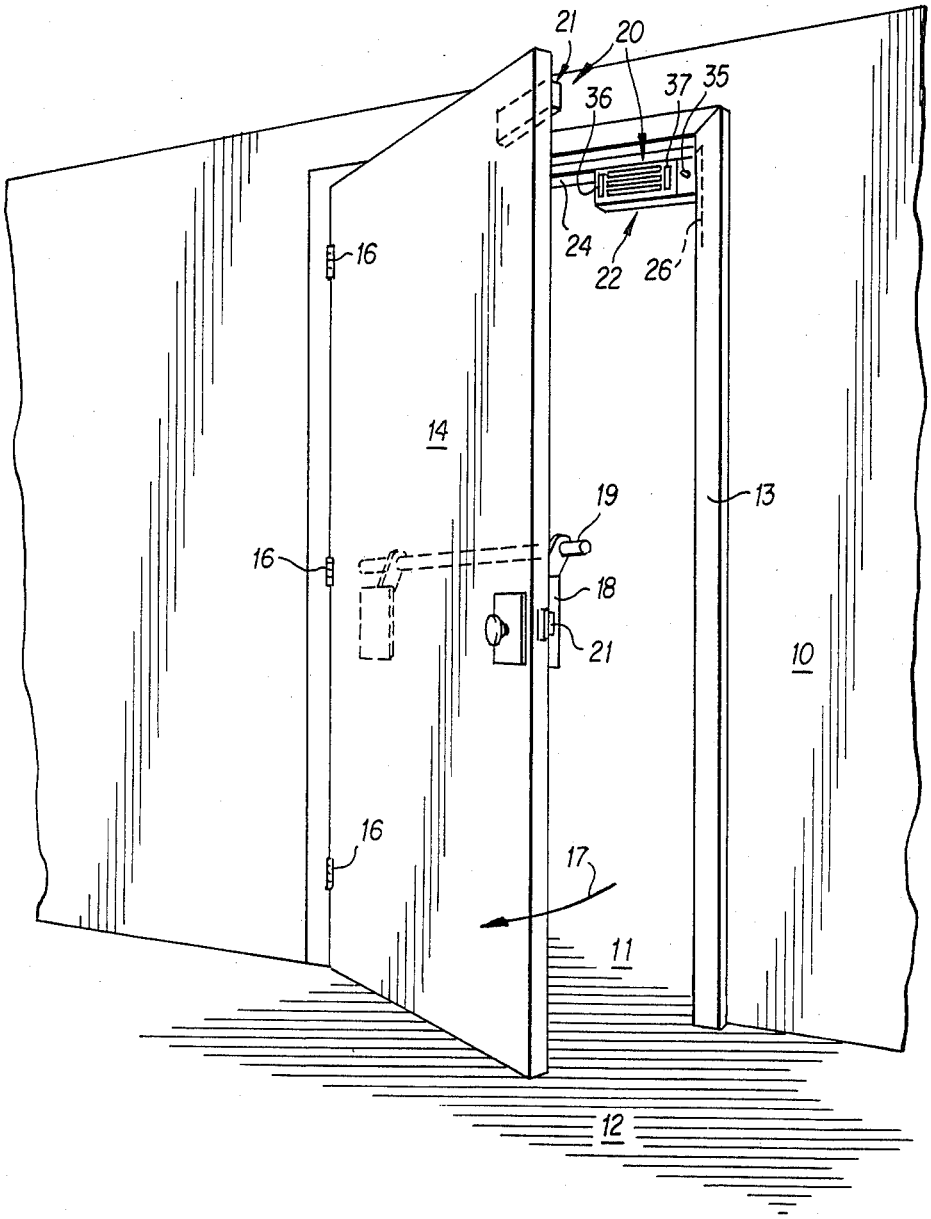
FIG. 1 is a perspective view of the instant invention installed on a door.

Refering now to FIG. 1, there is shown a wall 10 which is used to separate an interior space 11 from an exterior space 12. The wall has a door frame 13 mounted therein in which a door 14 is mounted to swing about hinges 16 from a closed position to an open position in the direction of arrow 17.

In the illustrated embodiment, the door 14 is equipped with standard panic lock hardware 18 including a panic bar 19. Normally, upon pressing the panic bar 19, the panic lock hardware 18 undogs or retracts a bolt 21 allowing the door 14 to swing open in the direction of the arrow 17.

In accordance with the instant invention, opening of the door 14 is further controlled by a magnetic lock, designated generally by the numeral 20, which lock includes an armature, designated generally by the numeral 21, and an electromagnet, designated generally by the numeral 22. The electromagnet 22 is mounted on the door frame 13 in an upper corner, preferably beneath and behind a top door jam 24 and inside and behind a side door jam 26. The armature 21 is mounted on the door 14 adjacent the top edge 28 of the door and the free edge 29 of the door. When the door 14 is closed and the electromagnet 22 is energized, the armature 21 is held by the electromagnet 22 with approximately 1200 pounds of force so that the door 14 cannot be forced open by a person inside the enclosure 11. The basic components of the lock 20 are similar to the lock manufactured and sold by "Rofu," a Swiss company. There are several other companies producing locks having an electromagnet 22 and an armature 21 suitable to supply the holding force necessary to secure the door 14 of the instant invention in a closed position.

In accordance with the features of the instant invention, the electromagnet 22 is equipped with a switch, designated generally by the numeral 35, which switch may be conveniently prositioned adjacent to the electromagnet 22. As will be further explained hereinafter, the armature 21 has structure thereon for engaging and operating the switch 35. Consequently, the switch 35 is used to sense if there is an attempt to open the door. In addition, there are a pair of contacts 36 and 37 disposed adjacent to the electromagnet 22. The contacts are bridged or closed by engagement with the armature 21 to indicate that the armature is correctly positioned with respect to the electromagnet 22.

Figure 2:
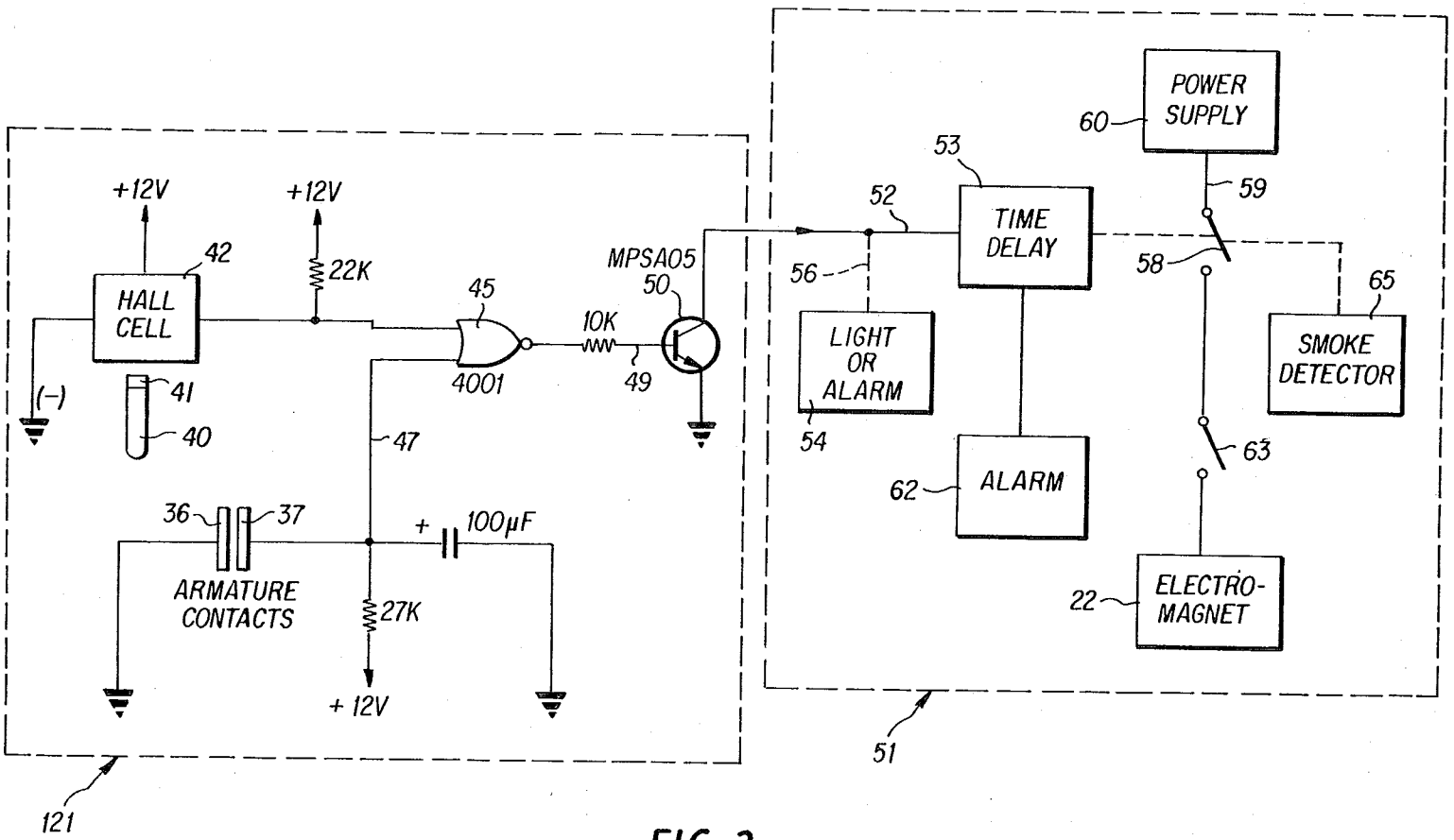
FIG. 2 is a diagram of a circuit which is included in the structure shown in FIG. 1.

Generally, the function of the lock 20 may be understood by reference to the circuit diagram of FIG. 2. As will be explained hereinafter, the switch 35 is preferably in the form of a plunger 40 having a magnet 41 thereon. The magnet 41 is positioned to operate a Hall cell 42 which is connected to a NOR-GATE 45 integrated circuit part no. (4001IC) via line 44. The NOR-GATE has another input 47 which is connected to the contacts 36 and 37 potted in the electromagnet 22 and positioned to be bridged or closed by the armature 21. NOR-GATE 45 is connected by an output line 49 to transistor 50 (part no. MPSAO5) which signals circuitry 51. The transistor 50 is connected to line 52 to a time delay circuit 53 in accordance with one embodiment of the invention, or directly to an indicator or alarm 54 via dotted line 56 in accordance with a second embodiment of the invention. Time delay 53 operates a switch 58 disposed in the power line 59 between an electromagnet power supply 60 and the electromagnet 22 to open the switch after a preselected time interval has expired. The details of the time delay system are set forth in detail in several of the patents aforelisted under "Related Patents" and in copending U.S. patent application Ser. No. 263,955. As in the other applications and patents listed under "Related Patents," the time delay 53 is connected to an alarm 62 which is activated once the time delay starts to count. A switch 63 is provided to open the circuit between the electromagnet 22 and the power supply 60 if one wishes to deactivate the lock 20 or for some reason to bypass the time delay. If necessary or desired, a smoke detector 65 or other emergency condition sensor may be connected in the line 59 to operate switch 63 and to cut power from the power supply 60 to the electromagnet 22. The appropriate circuitry for accomplishing this is also set forth in the aforementioned patents and more specifically set forth in U.S. patent application Ser. No. 263,955.

The circuit 39 set forth in FIG. 2 operates as follows. When the electromagnet 21 closes contacts 36 and 37, a low is placed on line 47. When the magnet 41 is in proximity with the Hall cell 42 (which is essentially a magnetically activated switch), a low is placed on line 44. These conditions inciate that door 14 is closed and that the armature 41 is correctly seated and held by the electromagnet 22. These conditions also provide a high output on line 49. As long as there is a high on line 49, the transistor 50 instructs the circuitry 51 that the door is both closed and electromagnetically locked. If the armature 21 is not correctly seated so as to close contacts 36 and 37, and the door 14 is closed and sensed by the Hall cell 42, then there will be a low on line 44 but a high on line 47. The NOR-GATE 45 then places a low output on line 49 and the transistor 50 signals the circuit 51 that the door is not properly locked. This feature prevents a culprit from defeating the lock by simply putting a piece of paper between the armature 21 and electromagnet 22. If the door 14 is open, then there will be a high on both lines 44 and 47 and a low on line 49 which low causes the transistor 50 to indicate that the door is not secure. When this is the case indicator 54 may be energized as well as the alarm 62.

Assuming both that the contacts 36 and 37 are closed by the armature 21 and that the magnet 41 is proximate the Hall cell 42, there will be lows on both lines 44 and 47 indicating a closed and secured door 14. However, if one attempts to open the door 14 by pressing against the inside surface thereof, the magnet 41 will slightly displace from the Hall cell 42 causing the Hall cell to place a high on line 44. Since armature contacts 36 and 37 are still closed by armature 21, there will be a low on line 47. This will cause NOR-GATE 45 to have a low output on line 49 and the transistor 50 will signal the time delay 53 to begin its count for delayed opening of the door 14. In addition, the time delay 53 will sound the alarm 62 so that the invention described herein operates in the same manner as the aforelisted "Related Patents."

Refering now to FIGS. 3 through 6, there are shown the specific details of the electromagnet 22 and armature 21 comprising the electromagnetic lock 20. The electromagnet 22 is contained in a housing 69 and is secured to the door frame 13 beneath and behind the door jam 24 by bolts 72 through end caps 73 of the electromagnet. If necessary, a block (not shown) or shims (not shown) may be used to correctly position the electromagnet 22. The armature 21 is secured to the door 14 by a pair of mounting bolts 75 which are received in sex nuts 76 within the door 14. The bolts 75 are shoulder bolts having smooth shank portions 77 received in bores 78 through the armature. The bores 78 are beneath relatively wide bores 80 which have a diameter greater than the heads 81 of the bolts 75. Surrounding each smooth shank 78 of the bolt 75 is a spring washer 83 which allows the armature 21 to float on the bolts 75. A tamper plate 85 is positioned behind the armature 21 and held in permanent abutment with the door 14 by washers 86. Secured to the tamper plate 85 by screws 88 is a striker 91 which does not float with respect to the tamper plate 85 or door 14. The striker 91 engages the plunger 40 of "switch 35" (see FIGS. 1 and 2) when the door 14 is shut.

Figure 4:
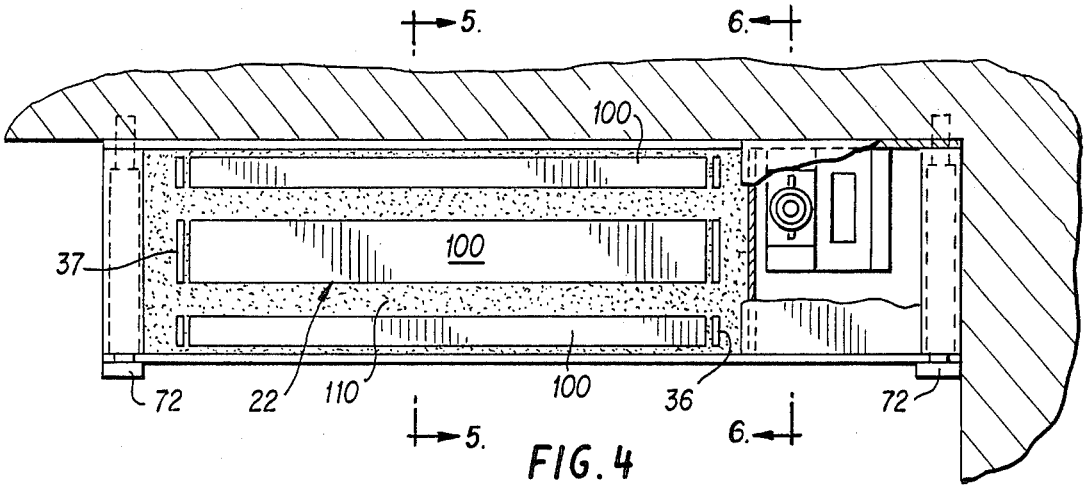
FIG. 4 is a cross-section of FIG. 3 taken on lines 4—4 of FIG. 3.
Figure 5:
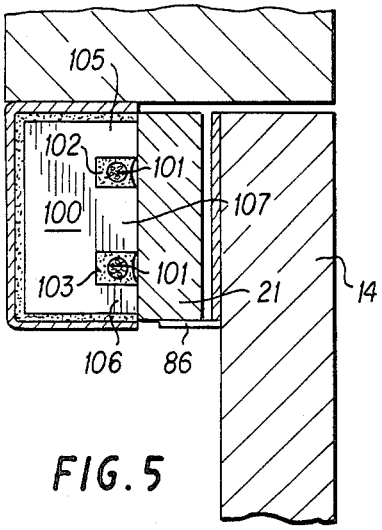
FIG. 5 is a cross-section on lines 5—5 of FIG. 4.

Refering now more specifically to FIGS. 4 and 5, the electromagnet 22 has a core 100 made up of "E" laminations (see FIG. 5). The winding 101 of the electromagnet 22 is disposed in spaces 102 and 103 of the electromagnet between the outer legs 105 and 106 and the center leg 107. The core 100 and winding 101 are embedded in a conventional potting compound 110. Also embedded in the potting compound 110 are the contacts 36 and 37 which are also in the form of "E" laminations. The contacts 36 and 37 are spaced from the core 100 and are insulated therefrom by the potting material 110. As is seen in FIG. 2, the lamination 36 is connected to ground while lamination 37 is connected to a 12-volt power supply. Upon closing the door 14, the armature 21 will close the contacts 36 and 37 if it is properly seated in and aligned with the core 100. In order to accomplish this, the laminations 36 and 37 have contact surfaces 112 which are in the same plane as the contact surfaces of the "E" laminations comprising the core 100. As has been previously discussed, when the armature 21 has closed the contacts 36 and 37 there is a low on input line 47 to NOR-GATE 45. When the armature 21 is not closing contacts 36 and 37, there is a high on input 47 to NOR-GATE 45.

Figure 3:
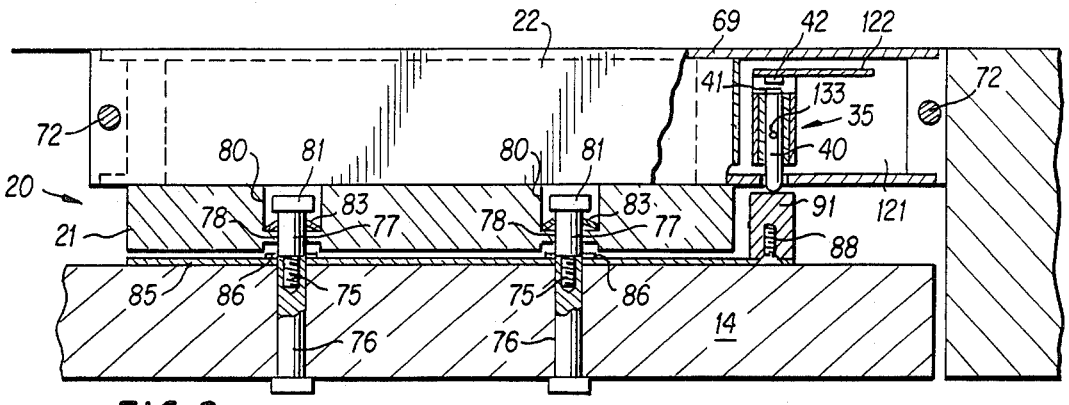
FIG. 3 is a bottom view of the electromagnet and armature of the instant invention, with portions cut away.
Figure 6:
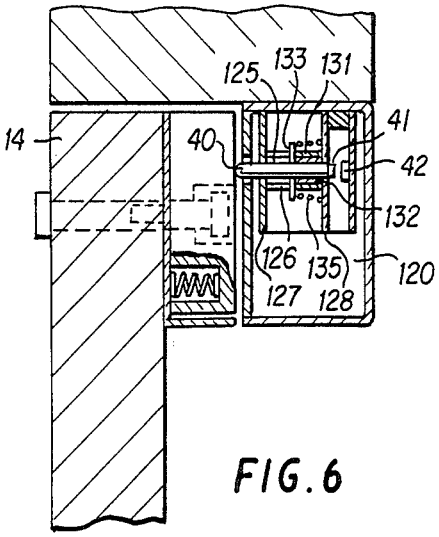
FIG. 6 is a cross-section taken on lines 6—6 of FIG. 4 showing a switch mechanism.

As is seen in FIGS. 3, 4 and 6, the switch 35 consisting of the plunger 40, magnet 41 and Hall cell 42 are all contained within a compartment 120 disposed beside the electromagnet 22. The circuitry of FIG. 2 within the dotted area 121 (See FIG. 2) is disposed on a printed circuit board 122 also within the compartment 120. As is seen in FIG. 6, the plunger 40 slides in a sleeve 125 that is contained in a sleeve housing 126. The sleeve housing 126 and sleeve 125 are psoitioned between end plates 128 and 129 which are secured at the top and bottom of the housing 69 enclosing the electromagnet 22 and compartment 120. The sleeve 125 and housing 126 have slots 131 and 132 therethrough through which projects pin 133, which pin passes through and is rigidly connected to plunger 40. A spring 135 is positioned between the pin 133 and end plate 128.

As is seen in FIGS. 3 and 6, when the door is closed and locked by virtue of the armature 21 being held by the electromagnet 22, the striker 91 presses the plunger 40 inwardly against the bias of spring 135 and positions the magnet 41 proximate to Hall cell 42. However, when a person in the enclosure 11 presses against either the panic bar 19 or if no panic bar against the inner surface of the door 14, the door 14 will move slightly allowing the plunger 36 to move outwardly a short distance from the housing 69. This movement displaces the magnet 41 from the Hall cell 42 and causes a high to be impressed on input line 44 of the NOR-GATE 45 (see FIG. 2), thus indicating that a person is attempting to open the door 14 and get out of the room 11. As was explained previously in this discussion with respect to FIG. 2, this occurrence of a high on input line 44 causes the time delay circuitry 53 to operate and in a preselected time interval to open switch 58 and deenergize the electromagnet 22, while at the same time sounding an alarm 62 adjacent the door 14.

While the switch 35 operates a time delay in the preferred embodiment of the invention, the switch 35 may also be used for other indicating purposes. For example, in situations where one simply wants to know that the door 14 is being tampered with, the switch 35 might simply light an indicator light 54 (see FIG. 2) and sound an alarm at a remote station, or if desired, sound an alarm, at a location adjacent to the door.

The foregoing disclosure sets forth structure which allows one to conveniently and inexpensively use electromagnet locks 20 with doors such as emergency exit doors without having to conduct electrical signals across the gap between the hinged edge of the door and the door frame. This is especially useful in situations where a time delay is used with a magnetic lock, or where some other signalling arrangement is used with a magnetic door.

The foregoing description of the preferred embodiment is merely illustrative of the instant invention which is to be limited only by the following claims.

I claim:

1. An exit door security system, said system comprising, in combination:

(a) an exit door frame;
(b) an exit door connected to said frame;
(c) an electromagnet connected to said frame;
(d) a magnetically attractable armature secured to said door adapted to be attracted to and held by said electromagnet;
(e) an alarm;
(f) a timer:
(g) a power source;
(h) an electric circuit electrically interconnecting said alarm, electromagnet, timer and power source; and,
(i) switch means connected in said circuit projecting beyond a portion of the door frame for engaging said door, said switch means being closed when said door is fully closed to allow activation of said electromagnet to prevent full opening of said door.

2. The system of claim 1, wherein said switch means is activated and deactivated by movement of said door.

3. The system of claim 2, wherein said switch means is deeactivated when said door is partially opened.

4. The system of claim 3, wherein partial opening of said door causes said switch to be deactivated, but allowing said electromagnet to continue to be energized because of said timer.

5. The system of claim 4, wherein said armature is moveably secured to said door.

6. The system of claim 2, wherein said armature continues to be attracted by said electromagnet when said door is partially opened even though said switch means has been opened.

7. The system of claim 6, wherein the system is automatically reset with the armature attracted by the electromagnet, when the door is closed

8. The system of claim 1, including means to activate said alarm upon parital opening of said door and maintain operation of the alarm until the door is again fully closed.

9. The system of claim 1, including means to activate an alarm upon partial opening of said door and means to allow complete opening of said door only after the lapse of a predetermined period of time after partial opening of said door.

10. The exit door security system of claim 1, wherein said alarm includes at least one of an audible signal generating means and a visual signal generating means.

11. The exit door security system of claim 1, wherein said switch comprises a spring biased plunger adapted tdo protrude from said frame towards said door and biasable into a closed contact position against said spring bias by said door when said door is closed against said frame.

12. The exit door security system of claim 1, wherein said magnetically attractable lock comprises an armature slideably secured to said door and freely moveable between a rearward position wholly disposed on said door and a forward position extending forward of said door towards said electromagnet, whereby when the door is fully closed, the armature continues to be magnetically attracted by said electromagnet when it moves relative to the door, bridging the opening space between said door and said frame and holding said door locked.

13. The exit door security system of claim 12, wherein said lock includes at least one slide bolt with expanded head disposed in slide channels in said armature, the rear end of said bolt being secured to said door, said bolt head being dimensioned relative to siad channel to prevent separation of said armature from said lock.

14. The exit door security system of claim 6, wherein said timer is automatically reset when said door is closed.

15. The exit door security system of claim 14, wherein said timer is electrically activated.

16. The exit door security system of claim 7, wherein said system can be overridden by an outside source and wherein removal of said power source results in deactivation of the electromagnet.

* * * * *

UNITED STATES PATENT AND TRADEMARK OFFICE

CERTIFICATE OF CORRECTION

PATENT NO. : 4,720,128

DATED : January 19, 1988

INVENTOR(S) : Emanuel L. Logan et al

It is certified that error appears in the above-identified patent and that said Letters Patent is hereby corrected as shown below:

Column 6, Line 34, Claim 3:

Reads: "is deeactivated when said door is partially opened."

should Read: --is deactivated when said door is partially opened.--

Column 6, Line 49, Claim 8:

Reads: "said alarm upon parital opening of said door and main-"

Should Read: --said alarm upon partial opening of said door and main---

Column 6, Line 62, Claim 11:

Reads: "tdo protrude from said frame towards said door and"

should read: --to protrude from said frame towards said door and--

Column 7, Line 13, Claim 13:

Reads: "said bolt head being dimensioned relative to siad chan-"

should Read: --said bolt head being dimensioned relative to said chan---

Signed and Sealed this

Fourth Day of October, 1988

*Attest:*

DONALD J. QUIGG

*Attesting Officer*

*Commissioner of Patents and Trademarks*